US005482494A

United States Patent [19]

Ishimoto

[11] Patent Number: 5,482,494

[45] Date of Patent: Jan. 9, 1996

[54] TOY VEHICLE HAVING ROLLING OSCILLATORY MOTION

[75] Inventor: Zenichi Ishimoto, Tokyo, Japan

[73] Assignee: Nikko Co., Ltd., Tokyo, Japan

[21] Appl. No.: 249,729

[22] Filed: May 26, 1994

[30] Foreign Application Priority Data

May 26, 1993 [JP] Japan ..... 5-123777

[51] Int. Cl.[6] ..... A63H 30/04

[52] U.S. Cl. ..... 446/456; 446/466; 446/428; 298/18

[58] Field of Search ..... 446/456, 437, 446/470, 428, 462, 466; 298/18, 17.6, 17.7, 18

[56] References Cited

U.S. PATENT DOCUMENTS

| | | | |
|---|---|---|---|
| 10,441 | 1/1854 | Bailey | 298/18 |
| 486,114 | 11/1892 | Linn | 298/18 |
| 1,495,171 | 5/1924 | Fraser | 298/35.1 |
| 3,450,436 | 6/1969 | Phillips | 298/18 |
| 3,662,488 | 5/1972 | Linstead | 446/428 |
| 3,948,341 | 4/1976 | Foster | 296/35.1 |
| 3,964,791 | 6/1976 | Griffis | 298/17.6 |
| 4,225,153 | 9/1980 | Bez et al. | 296/35.1 |
| 4,488,375 | 12/1984 | Cheng | 446/437 |
| 4,655,727 | 4/1987 | Swisher et al. | 446/470 |
| 4,892,502 | 1/1990 | Hesse | 446/454 |
| 5,173,072 | 12/1992 | Ozawa | 446/462 |
| 5,292,275 | 3/1994 | Swisher et al. | 446/470 |
| 5,322,469 | 6/1994 | Tilbor | 446/470 |
| 5,368,118 | 11/1994 | Hoefle | 296/35.1 |

*Primary Examiner*—Robert A. Hafer
*Assistant Examiner*—Michael O'Neill
*Attorney, Agent, or Firm*—Young & Thompson

[57] ABSTRACT

The invention provides a novel toy vehicle comprising a body, a chassis at least having an upper surface and a rolling oscillation generating unit provided on the upper surface of the chassis for permitting the body to exhibit a rolling oscillation motion around a horizontal axis. The rolling oscillation generating unit comprises a plate mounted to an internal surface of the body, a plurality of connection rods for mechanically and movably connecting the plate to the upper surface of the chassis, and at least a pushing up member mechanically connected to the chassis and having at least two contacting portions for contacting on a flat bottom surface of the plate at least at its two symmetrical positions spaced along a vertical direction to the horizontal axis so as to permit either of the two contacting portions to pushing up the bottom surface of the plate. The two contacting portions alternatively and continuously push up the bottom surface of the movable plate to permit both the movable plate and the body to show a rolling oscillation motion around the horizontal axis.

18 Claims, 10 Drawing Sheets

TOY VEHICLE HAVING ROLLING OSCILLATORY MOTION

BACKGROUND OF THE INVENTION

The invention relates to an improvement in a radio controlled toy vehicle.

Various types of radio controlled toy vehicles have been known to generally persons and particularly various toy motor vehicles are attractive to user such as children. The majority of such conventional radio controlled toy motor vehicles were able to show various traveling performances such as forward/reverse traveling and right and left turns. The conventional radio controlled toy motor vehicles were further able to generate various types of dummy engine sounds in combination of light on and off performance.

Whereas one of the conventional radio controlled toy motor vehicles was designed to permit a body of the motor vehicle to exhibit a vertical motion or an up-and-down motion with an amplitude and at a predetermined time interval, such toy motor vehicle was not yet attractive to the users. Another one of the conventional radio controlled toy motor vehicles was designed to be able to show a spin motion with no slide motion nor fall down, such toy vehicle was, however, not attractive to the users.

User's attentions and interests are now directed to high quality performances or much more complicated and unique performances shown by the radio controlled toy vehicles. It would, therefore, be required to develop a novel radio controlled toy motor vehicle which is able to show a unique performance which may be sufficiently attractive to users.

SUMMARY OF THE INVENTION

Accordingly, it is a primary object of the present invention to provide a novel toy vehicle which may be sufficiently attractive to users.

It is a further object of the present invention to provide a novel radio controlled toy traveling vehicle which is able to shown an attractive and unique performance.

The above and other objects, features and advantages of the present invention will be apparent from the following descriptions.

The invention provides a novel toy vehicle comprising a body, a chassis at least having an upper surface and a rolling oscillation generating unit being provided on said upper surface of said chassis for permitting said body to exhibit a rolling oscillation motion around a horizontal axis. The rolling oscillation generating unit comprises a plate being mounted to an internal surface of said body, a plurality of connection rods for mechanically and movably connecting said plate to said upper surface of said chassis, and at least a pushing up member being mechanically connected to said chassis and having at least two contacting portions for contacting on a flat bottom surface of said plate at least at its two symmetrical positions being spaced along a vertical direction to said horizontal axis so as to permit either of said two contacting portions to pushing up said bottom surface of said plate. The two contacting portions alternatively and continuously push up said bottom surface of said movable plate to permit both said movable plate and said body to show a rolling oscillation motion around said horizontal axis.

BRIEF DESCRIPTIONS OF THE DRAWINGS

Preferred embodiments of the present invention will hereinafter fully be described in detail with reference to the accompanying drawings.

PREFERRED EMBODIMENTS OF THE INVENTIONS

A preferred embodiment according to the present invention will be described in detail with reference to the accompanying drawings in which a novel radio controlled toy traveling vehicle is provided. A novel radio controlled toy traveling vehicle is able to show an attractive performance, for example, the toy traveling vehicle is designed to permit a body of the vehicle to show a careening oscillation motion.

Figure 1:
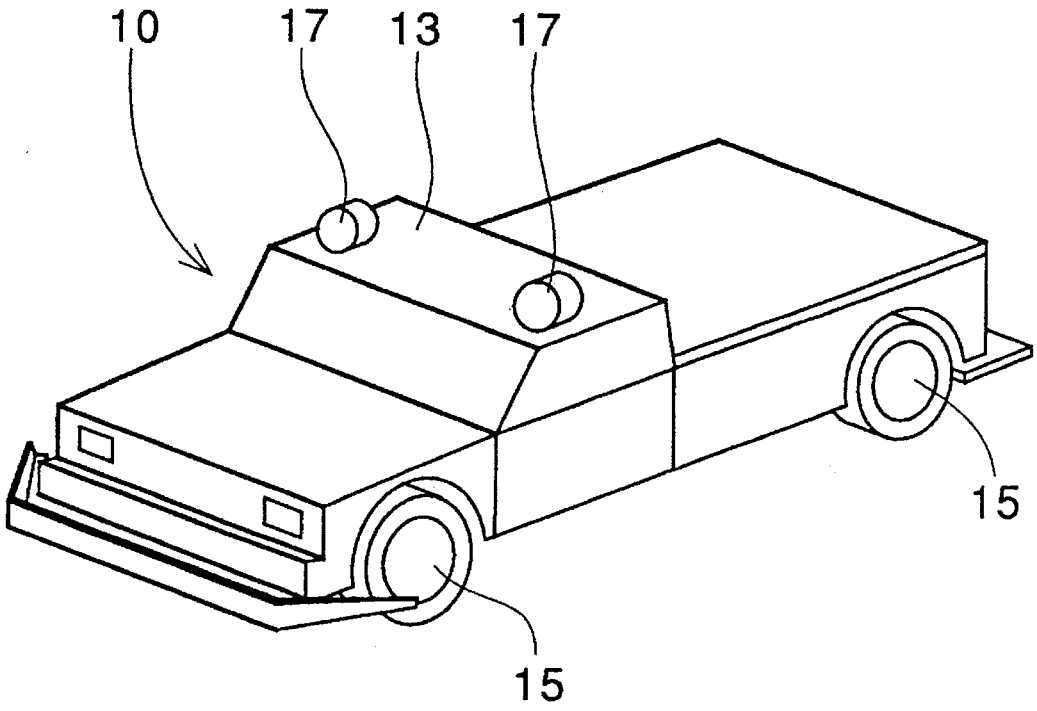
FIG. 1 is a perspective view illustrative of a radio controlled toy traveling vehicle according to the present invention.
Figure 2:
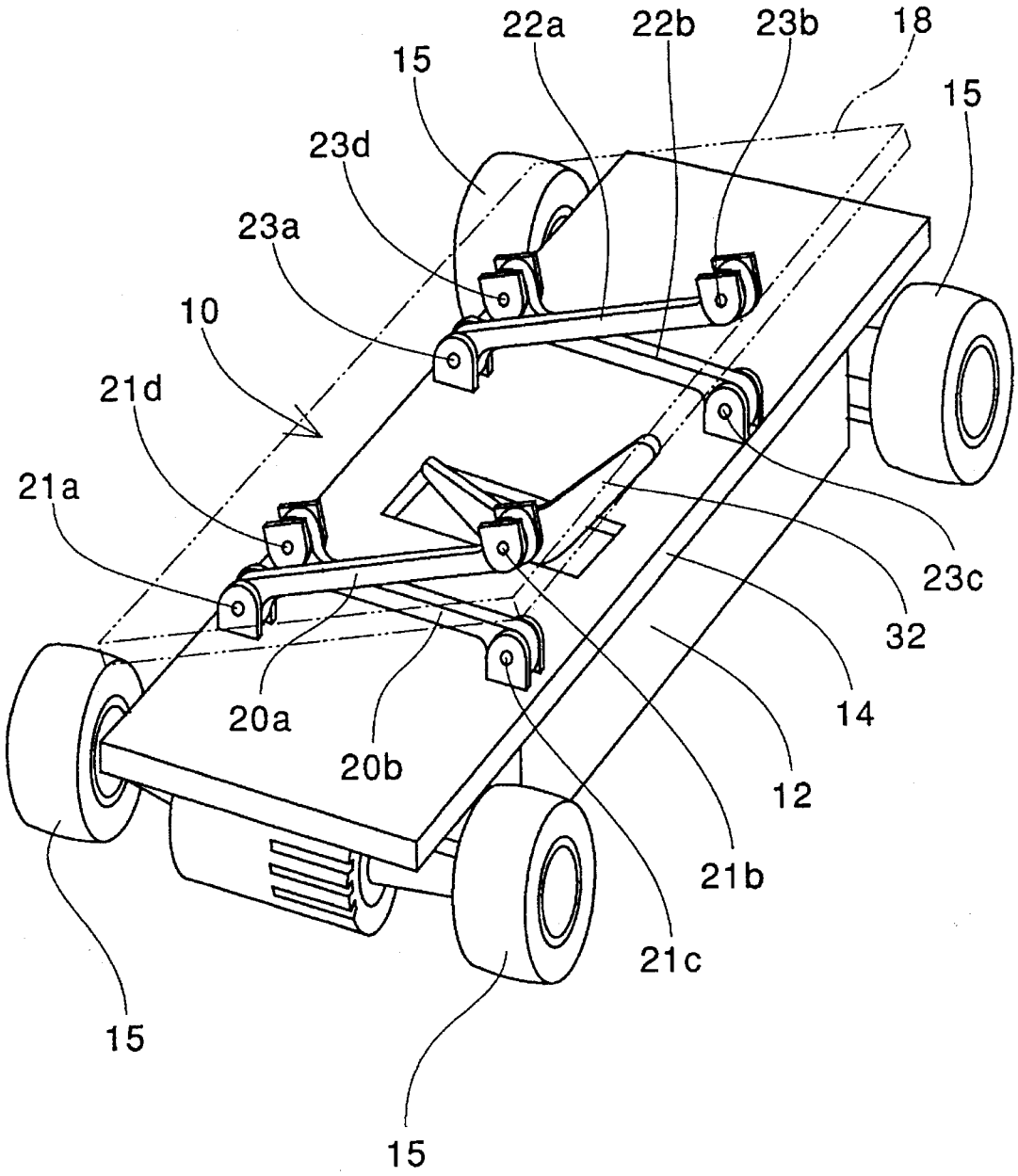
FIG. 2 is a perspective view illustrative of an internal careening oscillation mechanism involved in a radio controlled toy traveling vehicle according to the present invention.

An external shape of the novel radio controlled toy traveling vehicle is as illustrated in FIG. 1, while the novel radio controlled toy traveling vehicle has an internal mechanism to allow the body thereof to exhibit an attractive careening oscillation motion as illustrated in FIG. 2.

Referring to FIG. 1, the novel radio controlled toy traveling vehicle comprises a chassis and a body provided on the chassis. The chassis is provided with four tires 15. The body comprises a front portion with bonnet, a cabin 13 with top lights 17 and a rear portion. The internal careening oscillation mechanism is provided to the chassis to permit the body to show the careening oscillation motion.

Referring to FIG. 2, the chassis 12 is provided with a fixed plate 14 fixed thereon, while the movable body is provided on a movable plate 18 which is so supported by the careening oscillation mechanism as to permit the movable plate 18 to show an oscillating and rotating motion around a longitudinal axis in a predetermined range of angle of the rotation. Such the careening oscillation mechanism is provided on the chassis to so support the movable plate 18 as to permit the body to perform the careening oscillation motion.

The movable plate 18 is mechanically connected through first and fourth connection rods 20*a*, 20*b*, 22*a* and 22*b* to the fixed plate 14 provided on the chassis 12. The first connection rod 20*a* is provided at its opposite ends with first and second brackets 21*a* and 21*b*. The first bracket 21*a* is mounted on an upper surface of the fixed plate 14 at a first side or left side. The second bracket 21*b* is mounted on a bottom surface of the movable plate 18 at a second side or right side. The right side of the movable plate 18 is mechanically connected to the left side of the fixed plate 14 through the first connection rod 20*a*. The first connection rod 20*a* is pivotally connected to each of the first and second brackets 21*a* and 21*b* so as to permit the movable plate 18 to careen toward the left.

The second connection rod 20*b* is provided at its opposite ends with third and fourth brackets 21*c* and 21*d*. The third bracket 21*c* is mounted on the upper surface of the fixed plate 14 at the right side. The fourth bracket 21*d* is mounted on the bottom surface of the movable plate 18 at the left side. The left side of the movable plate 18 is mechanically connected to the right side of the fixed plate 14 through the second connection rod 20*b*. The second connection rod 20*b* is pivotally connected to each of the third and fourth brackets 21*c* and 21*d* so as to permit the movable plate 18 to careen toward the right.

The first and second rods 20*a* and 20*b* are provided at the rear side of the vehicle, while the third and fourth rods 22*a* and 22*b* are provided at the front side of the vehicle. The third connection rod 22*a* is also provided at its opposite ends with fifth and sixth brackets 23*a* and 23*b*. The fifth bracket 23*a* is mounted on the upper surface of the fixed plate 14 at the left side. The sixth bracket 23*b* is mounted on the bottom surface of the movable plate 18 at the right side. The right side of the movable plate 18 is mechanically connected to the left side of the fixed plate 14 through the third connection rod 22*a*. The third connection rod 22*a* is pivotally connected to each of the fifth and sixth brackets 23*a* and 23*b* so as to permit the movable plate 18 to careen toward the left.

The fourth connection rod 22*b* is provided at its opposite ends with seventh and eighth brackets 23*c* and 23*d*. The seventh bracket 23*c* is mounted on the upper surface of the fixed plate 14 at the right side. The eighth bracket 23*d* is mounted on the bottom surface of the movable plate 18 at the left side. The left side of the movable plate 18 is mechanically connected to the right side of the fixed plate 14 through the fourth connection rod 22*b*. The fourth connection rod 22*b* is pivotally connected to each of the seventh and eighth brackets 23*c* and 23*d* so as to permit the movable plate 18 to careen toward the right.

As described above, the first and second connection rods 20*a* and 20*b* are symmetrically provided to each other, but the both are separated in the longitudinal direction from the third and fourth rods 22*a* and 22*b* which are also symmetrically provided to one another.

The careening oscillation mechanism also includes a V-shaped pushing up lever 32 being provided in the vertical direction to the longitudinal axis for pushing up either side of the movable plate 18. The V-shaped pushing up lever 32 is pivotally connected to the chassis 12 to rotate in a predetermined range of the angle so as to permit either right or left top portion of the V-shaped pushing up lever 32 to contact with and push up the bottom surface of the movable plate 18. The fixed plate 14 has a rectangular-shaped opening through which the V-shaped pushing up lever projects. Pushing up the movable plate 18 with rising the right top portion of the V-shaped pushing up lever 32 leads to the careening of the movable plate toward the left, while pushing up the movable plater 18 with rising the left top portion of the V-shaped pushing up lever 32 also leads to the careening of the movable plate but toward the right. The movable plate 18 may be provided on its bottom surface with contact portions for contacting with the right and left top portions of the V-shaped pushing up lever 32.

Figure 3:
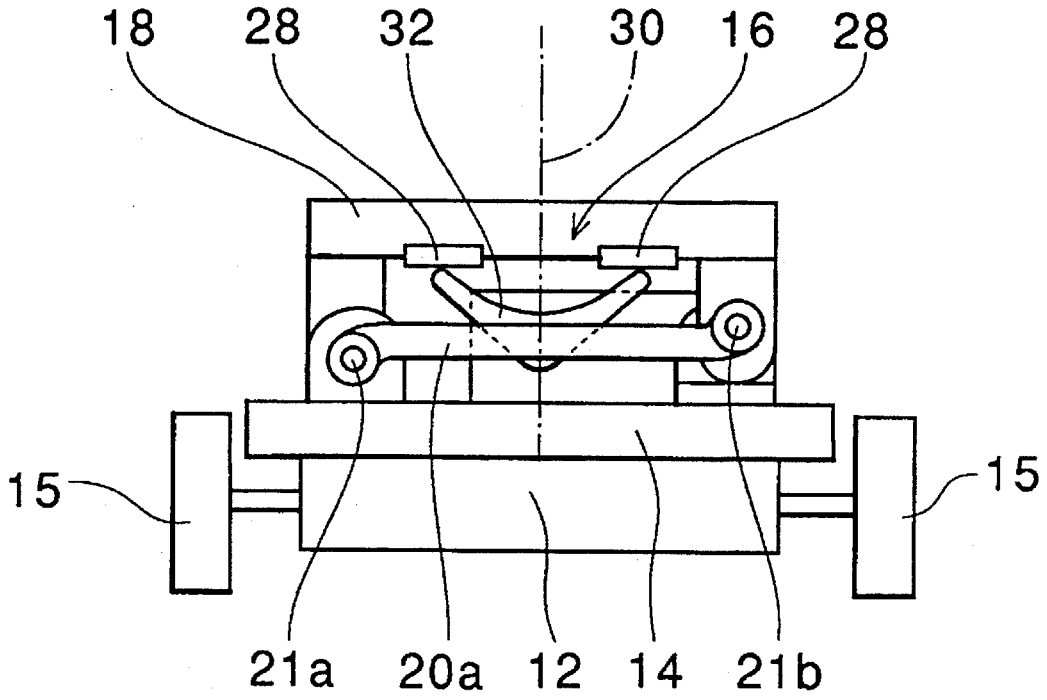
FIG. 3 is a fragmentary cross sectional view illustrative of a careening oscillation mechanism of a radio controlled toy traveling vehicle according to the present invention.

As illustrated in FIG. 3, no rotation of the V-shaped pushing up lever 32 results in no slop of the movable plate 18 thereby the body of the toy traveling vehicle shows no careening motion.

Figure 4A:
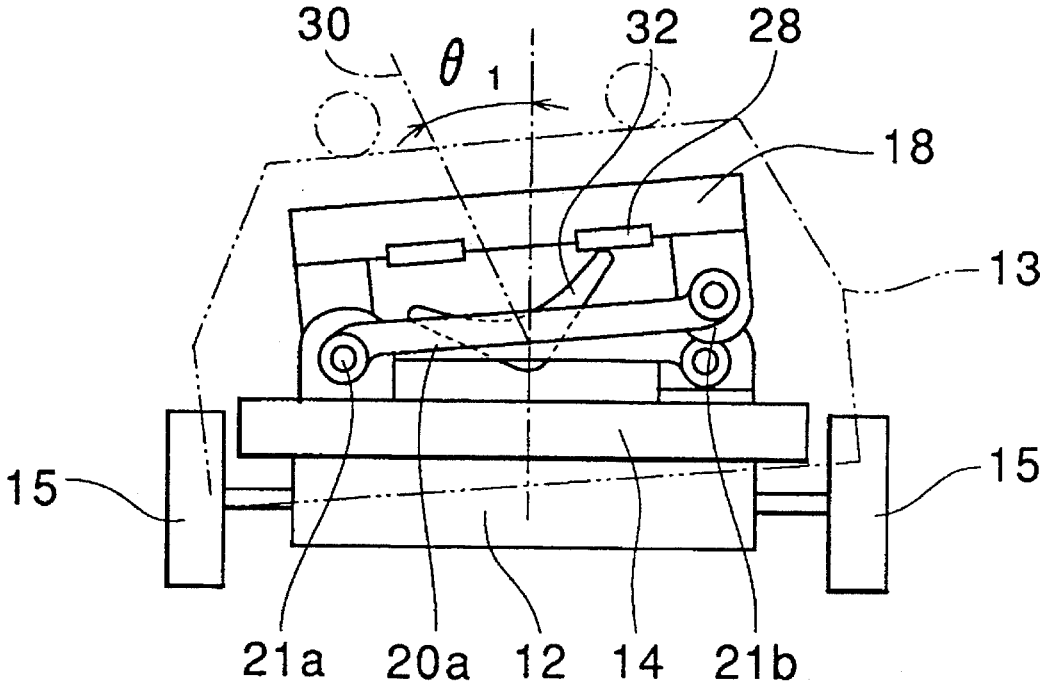
FIG. 4A is a fragmentary cross sectional view illustrative of a careening oscillation mechanism of a radio controlled toy traveling vehicle according to the present invention.
Figure 4B:
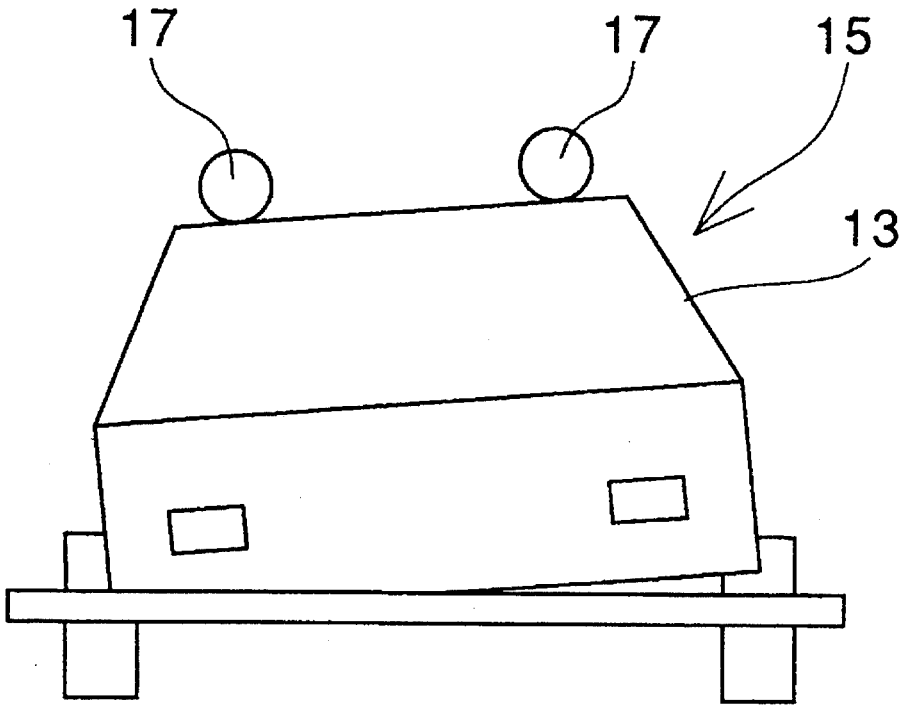
FIG. 4B is a front view illustrative of a careening motion to the left of a radio controlled toy traveling vehicle according to the present invention.

As illustrated in FIGS. 4A and 4B, a counterclockwise rotation of the V-shaped pushing up lever 32 causes the movable plate 18 to slop toward the left thereby the body of the toy traveling vehicle is able to show a slop motion toward the left.

Figure 5A:
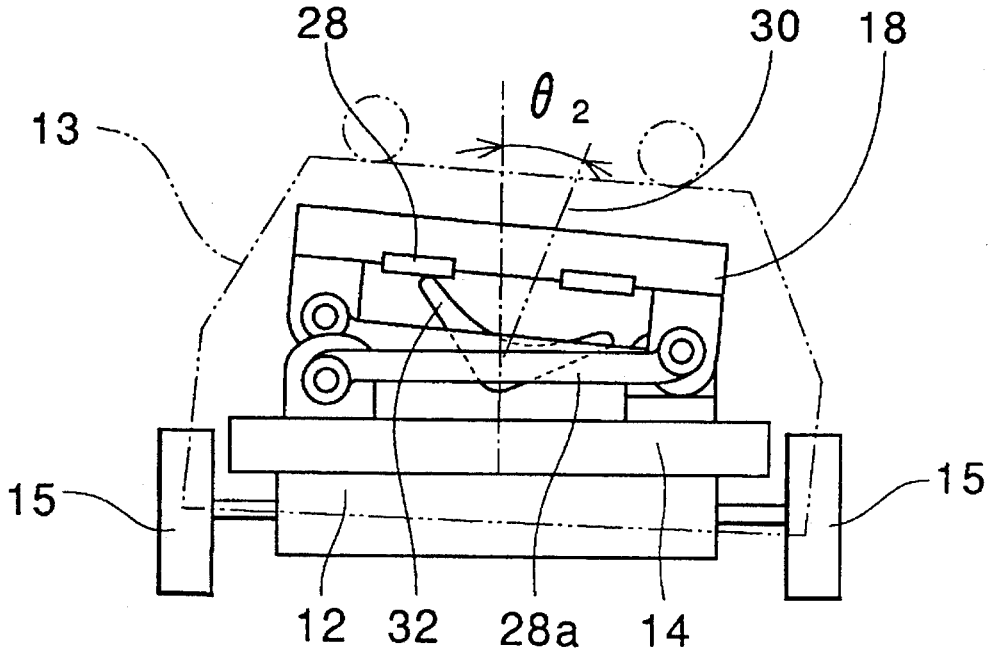
FIG. 5A is a fragmentary cross sectional view illustrative of a careening oscillation mechanism of a radio controlled toy traveling vehicle according to the present invention.
Figure 5B:
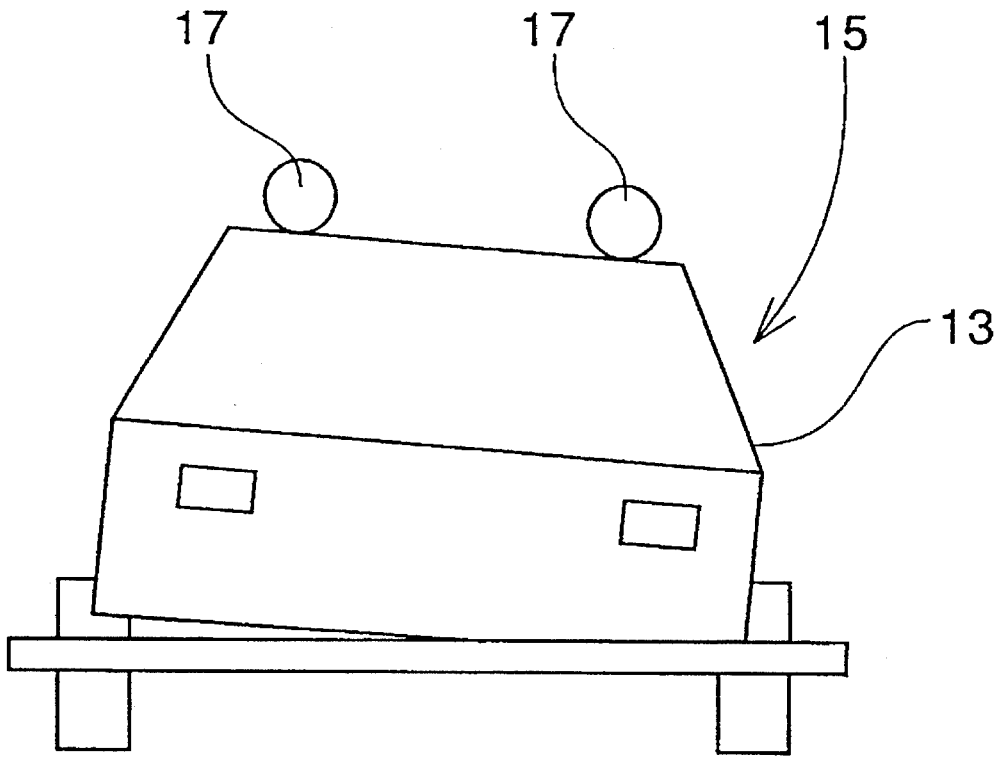
FIG. 5B is a front view illustrative of a careening motion to the right of a radio controlled toy traveling vehicle according to the present invention.

As illustrated in FIGS. 5A and 5B, a clockwise rotation of the V-shaped pushing up lever 32 causes the movable plate 18 to slop toward the right thereby the body of the toy traveling vehicle is able to show a slop motion toward the right.

Referring back to FIG. 2, the first and third connection rods 20*a* and 22*a* can be provided at their opposite ends with coil springs (not shown) to serve to bring the right side of the movable plate 18 down unless any pushing up motion is caused with the right top portion of the V-shaped pushing up lever 32. By contrast, the second and fourth connection rods 20*b* and 22*b* can be provided at their opposite ends with coil springs (not shown) to serve to bring the left side of the movable plate 18 down unless any pushing up motion is caused with the left top portion of the V-shaped pushing up lever 32.

Figure 6A:
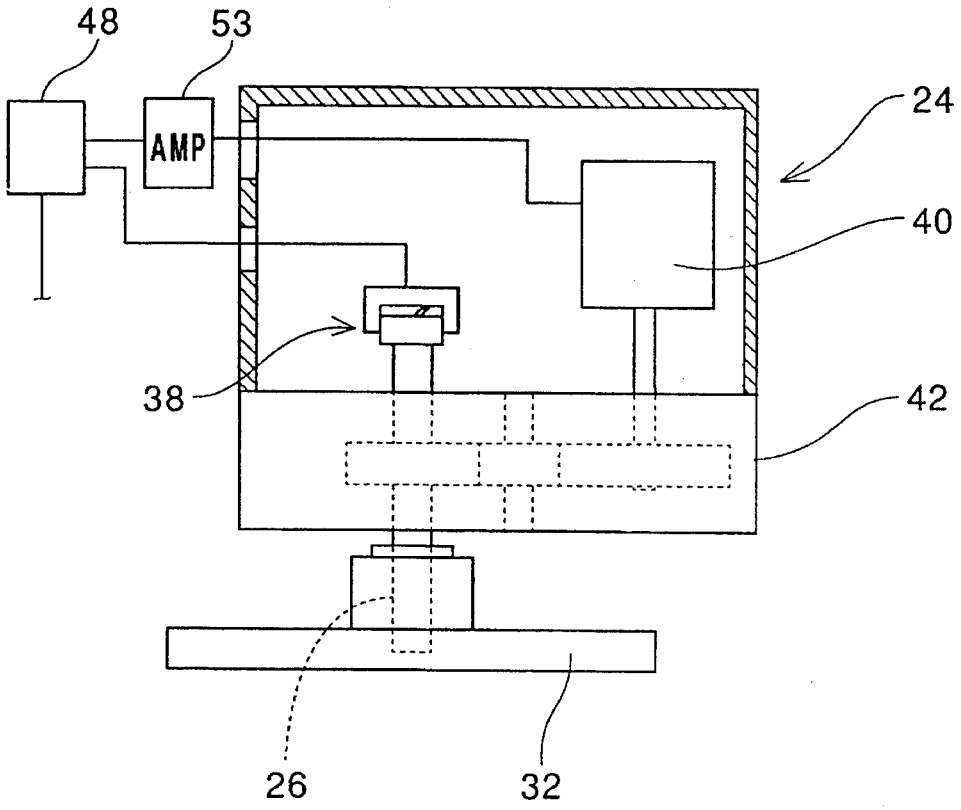
FIG. 6A is a fragmentary plane view illustrative of an internal careening oscillation mechanism involved in a radio controlled toy traveling vehicle according to the present invention.
Figure 6B:
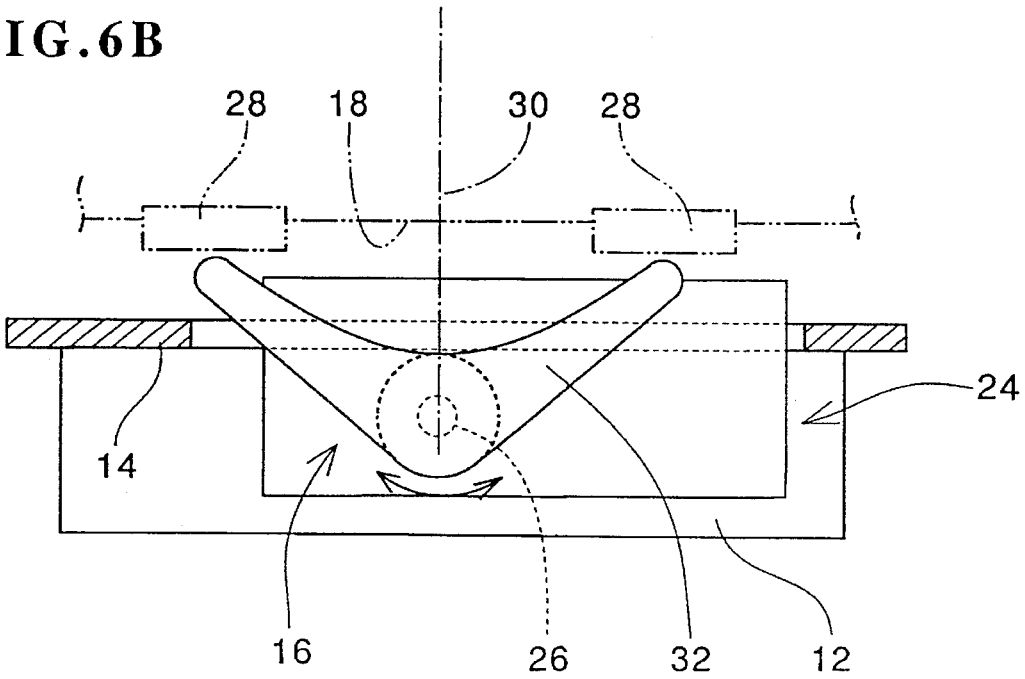
FIG. 6B is a fragmentary vertical view illustrative of an internal careening oscillation mechanism involved in a radio controlled toy traveling vehicle according to the present invention.

Referring to FIGS. 6A and 6B, the V-shaped pushing up lever 32 is able to show a rotational oscillation motion in cooperation with a pushing up lever driver unit 24. The V-shaped pushing up lever 32 is mechanically connected through its base portion of V-shape to one end of a lever driving shaft 26. The lever driving shaft 26 is mechanically connected through its opposite end to a rotational angle detector 38 for detecting a rotational angle of the V-shaped pushing up lever 32. The rotational angle detector 38 is electrically connected to a control IC 48 to transmit an signal having an information as to the rotational angle of the V-shaped pushing up lever 32. The control IC 48 is also electrically connected through an amplifier 53 to a servomotor 40. The servomotor 40 can be mechanically connected through a motor driving shaft (not shown) and reduction gears (not shown) to the lever driving shaft 26. The rotational angle detector 38 is mechanically united through the lever driving shaft 26 to the V-shaped pushing up lever 32 to permit the rotational angle detector 38 to sense or to have the same rotational angle as that of the V-shaped pushing up lever 32.

The rotational angle detector 38 may transmit no signal to the control IC 48 until the V-shaped pushing up lever 32 rotates by a predetermined rotation angle. When the rotation angle of the V-shaped pushing up lever 32 just reaches the predetermined rotation angle, the rotational angle detector 38 may output an signal having an information as to the critical angle of the V-shaped pushing up lever. The angle informational signal is transmitted to the controller IC 48. Just when the controller IC receives the angle informational signal from the rotational angle detector 38, the controller IC recognizes that it is required to invert the direction of the rotation of the servomotor 40. Then the controller IC outputs a reverse instructional signal to be transmitted through an amplifier 53 to the servomotor 40. When the servomotor 40 receives the reverse instructional signal from the control IC 48, the servomotor 40 shows an inversion of the rotational direction thereof. The motor driving shaft mechanically connected to the servomotor 40 then shows an inversion of the rotational direction thereof. The lever driving shaft 26 mechanically connected through the reduction gears 42 to the servomotor 40, therefore, shows an inversion of the rotational direction thereof. This results in an inversion of the rotational direction of the V-shaped pushing up lever 32. The rotational motion of the V-shaped pushing up lever 32 in the reverse direction to the previous rotational motion thereof is continued until the rotational angle of the V-shaped pushing up lever 32 reaches the predetermined angle. Just when the rotational angle of the V-shaped pushing up lever 32 reaches the predetermined angle, the rotational direction of the V-shaped pushing up lever 32 is again inverted. The above described rotational motion is repeated to permit the V-shaped pushing up lever 32 to show a periodic rotational motion or a rotational oscillation motion in the predetermined rotational angle at a predetermined time period.

Such the periodic rotational motion or the rotational oscillation motion results in the careening oscillation motions of the movable plate 18, which are caused by alternate pushing up operations with the right and left top portions of the V-shaped pushing up lever 32. This results in the careening oscillation motions of the body provided on the movable plate 18. The improved radio controlled toy traveling vehicle is able to show such an attractive careening oscillation motion or a periodic rolling motion of the body except for the chassis.

Figure 8:
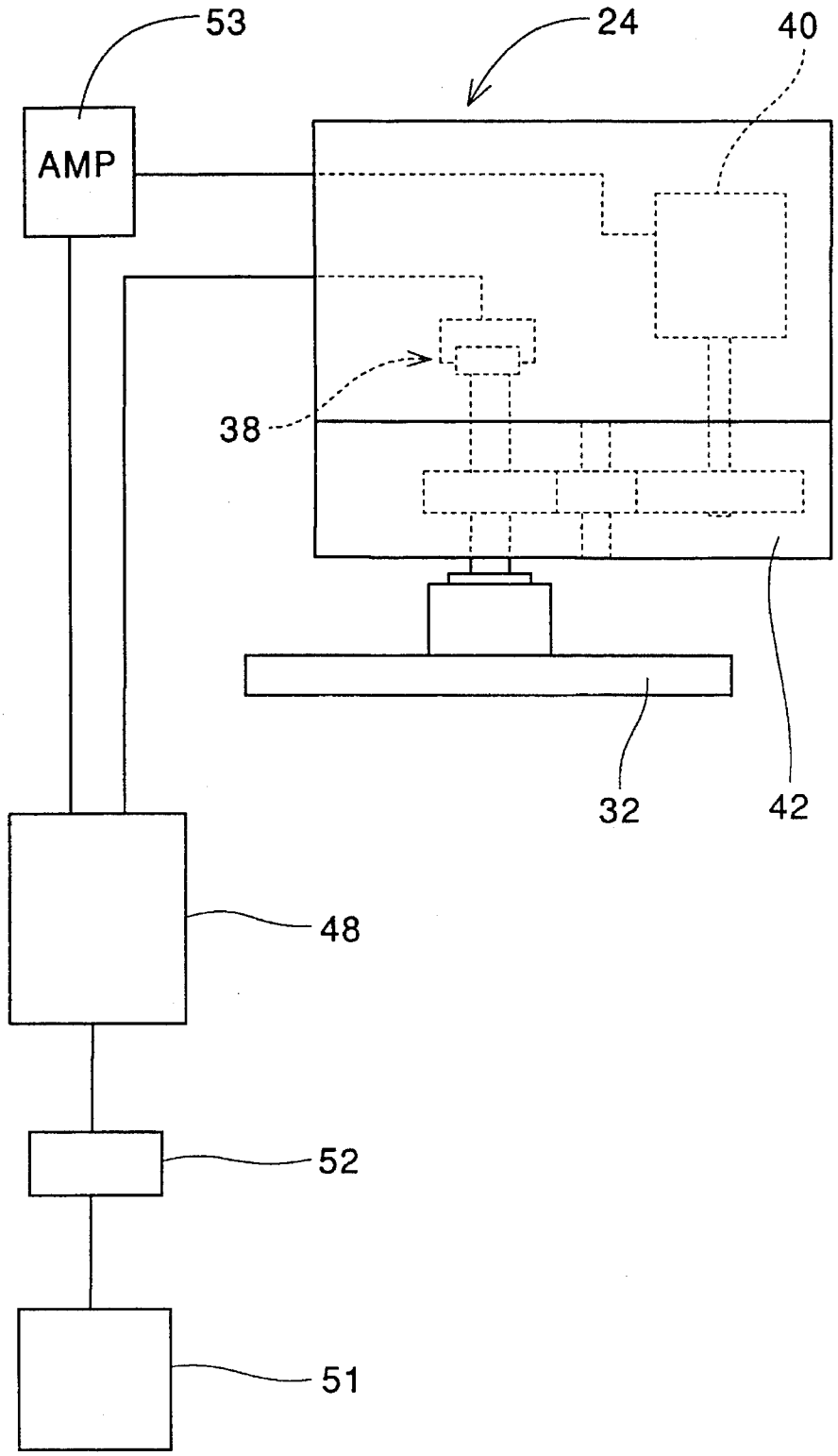
FIG. 8 is a diagram illustrative of a careening oscillation control unit involved in a radio controlled toy traveling vehicle according to the present invention.

Needless to say, it would also be necessary to supply a power to the pushing up lever driver unit 24 involving the servomotor 40 to obtain the periodic rotation motion of the V-shaped pushing up lever 32 which enables the body provided on the movable plate 18 to exhibit an attractive rolling oscillation motion. It may be available that as illustrated in FIG. 8 the pushing up driver unit 24 is electrically connected through the amplifier 53 and the controller IC 48 to a power supply 51. It may also be available to provide a power switch between the power supply 51 and the controller IC. Control of the power switch may be placed under either a hand control or a radio control.

Figure 7:
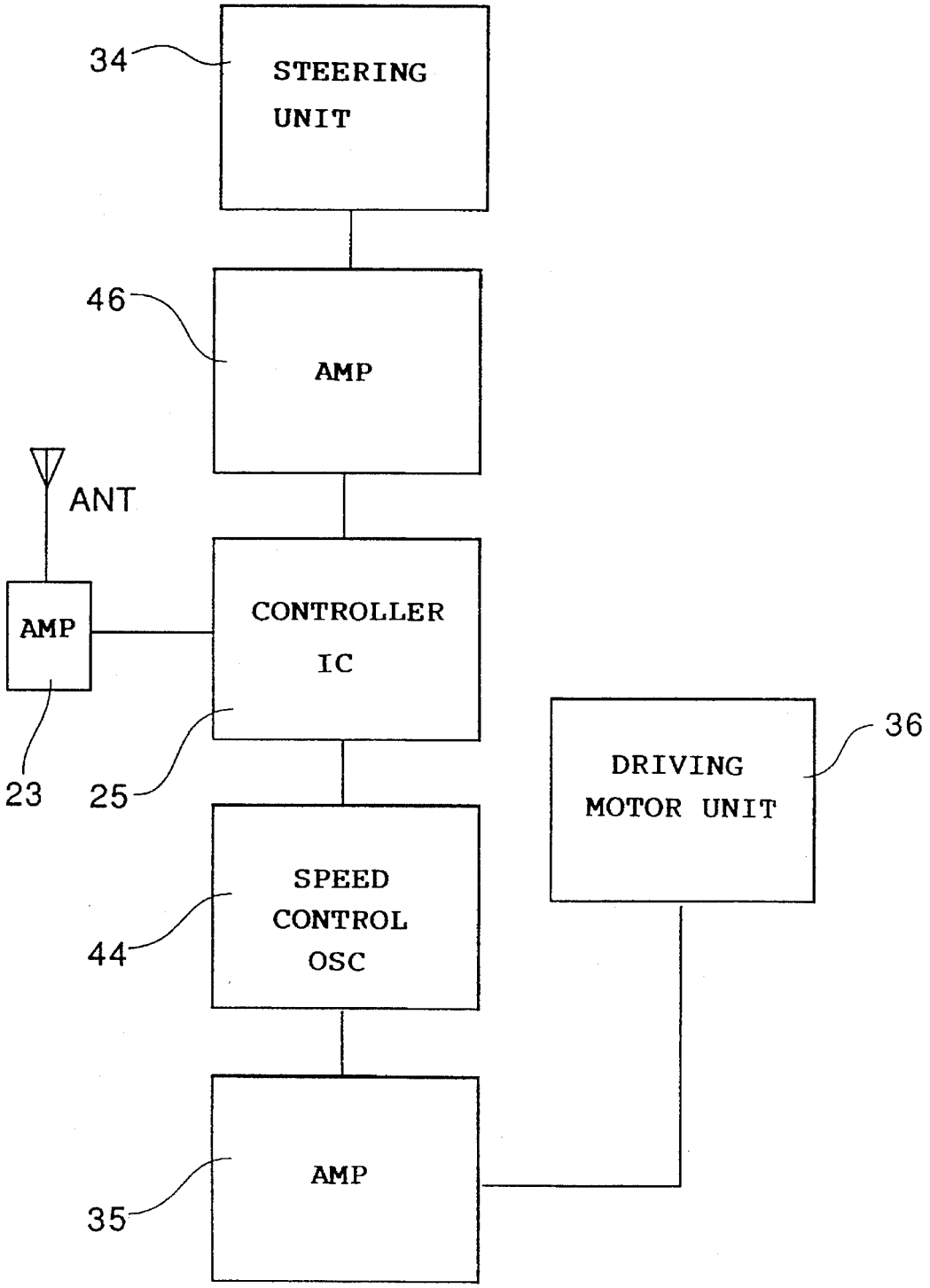
FIG. 7 is a diagram illustrative of a control system for a steering unit and a driving traveling unit involved in a radio controlled toy traveling vehicle according to the present invention.

In this preferred embodiment, steering control and speed control of the toy traveling vehicle are placed under the radio control from a transmitter not illustrated. As illustrated in FIG. 7, the users may operate the transmitter to control the steering operation and the speed of the traveling vehicle. The radio controlled toy traveling vehicle may be provided with a linear antenna to receive radio waves having informations as to the controls of the steering motion and speed of the vehicle. The radio waves received by the linear antenna are converted into electrical signals having the informations about the controls of the steering operation and the speed. The informational signals are transmitted through an amplifier 23 to a control IC 25 which is electrically connected through an amplifier 46 to a steering unit 34. The controller IC may transmit signals having instructional informations about the steering operations to the steering unit 43. The steering unit 43 receives the steering operation signals to perform the steering operation according to the instruction from the operator. The control IC is also electrically connected through a speed control OSC and an amplifier 35 to a driving motor unit 36. The controller IC may transmit signals having instructional informations about the speed control to the driving motor unit 36. The driving motor unit 26 receives the speed control signals to control the speed of the toy traveling vehicle according to the instruction from the operator.

The radio controlled toy traveling vehicle may further be provided with a sound generator for generating a dummy engine sound. The generation of such an engine sound may be placed under the radio control or the hand control.

Although in the preferred embodiment the careening oscillation mechanism for permitting the body of the vehicle to exhibit an attractive careening oscillation motion or a periodic rolling motion is applied to the radio controlled toy traveling vehicle, it would of course be possible to apply such the careening oscillation mechanism to any other toys such as non-radio controlled toy traveling vehicles and non-traveling toy vehicle, and further non-vehicle toys.

Whereas modifications of the present invention will no doubt be apparent to a person having ordinary skill in the art, to which the invention pertains, it is to be understood that the embodiments shown and described by way of illustrations are by no means intended to be considered in a limiting sense. Accordingly, it is to be intended to cover by the claims all modifications of the present invention which fall within the spirit and scope of the invention.

What is claimed is:

1. A toy vehicle comprising:

a body;

a chassis at least having an upper surface; and means provided on said upper surface of said chassis for permitting said body to exhibit a rolling oscillation motion around a horizontal axis, said means comprising:

a plate mounted on an internal surface of said body;

a plurality of connection rods for mechanically and movably connecting said plate to said upper surface of said chassis; and at least a pushing up member mechanically connected to said chassis and having at least two contacting portions for contacting on a flat bottom surface of said plate at least at two symmetrical positions on opposite sides of a vertical plane containing said horizontal axis so as to permit either of said two contacting portions to push up said bottom surface of said plate wherein said two contacting portions alternatively and continuously push up said bottom surface of said movable plate to permit both said movable plate and said body to show a rolling oscillation motion around said horizontal axis, wherein said pushing up member comprises a V-shaped lever including a base portion pivotally connected to said chassis and two top pushing up portions spaced from each other on opposite sides of said plane.

2. The toy vehicle as claimed in claim 1, wherein said V-shaped lever is mechanically connected through a shaft to a rotator which is controllable to exhibit a rotational oscillation motion in a range of a rotational angle at a time period.

3. The toy vehicle as claimed in claim 2, wherein said V-shaped lever is further mechanically connected through a shaft to a rotation angle detector electrically connected to a controller electrically connected to a rotator so as to permit said rotational angle detector to detect a rotational angle of said V-shaped lever so that when a rotational angle detected by said detector reaches a predetermined critical angle, said detector outputs a critical angle signal to be transmitted to said controller and subsequently said controller supplies an inversion signal to said rotator whereby the direction of the rotation of said rotator is reversed.

4. The toy vehicle as claimed in claim 3, wherein said rotator comprises a servomotor.

5. The toy vehicle as claimed in claim 1, wherein said connection rods comprise:

a first connection rod having one end pivotally connected with said upper surface of said chassis at its first side and the opposite end pivotally connected with said bottom surface of said movable plate at its second side and said first connection rod extending across said longitudinal axis of said vehicle;

a second connection rod having one end pivotally connected with said upper surface of said chassis at its second side and the opposite end pivotally connected with said bottom surface of said movable plate at its first side, said second connection rod extending across said longitudinal axis of said vehicle and said second connection rod also being parallel to and adjacent to said first connection rod;

a third connection rod having one end pivotally connected with said upper surface of said chassis at its first side and the opposite end pivotally connected with said bottom surface of said movable plate at its second side, said third connection rod extending across said longitudinal axis of said vehicle and said third connection rod being spaced from said first and second connection rods along said longitudinal axis; and a fourth connection rod having one end pivotally connected with said upper surface of said chassis at its second side and the opposite end pivotally connected with said bottom surface of said movable plate at its first side, said fourth connection rod extending across said longitudinal axis of said vehicle and said fourth connection rod also being parallel to and adjacent to said third connection rod.

6. The toy vehicle as claimed in claim 5, wherein each of said first to fourth connection rods is provided at its opposite ends with brackets fixed to said upper surface of said chassis or said bottom surface of said movable plate.

7. The toy vehicle as claimed in claim 1, further comprising:

at least two pairs of tires so provided through shafts to said chassis as to permit tires to freely rotate;

at least an antenna for receiving radio wave signals from a transmitter and subsequently converting said radio wave signals into electrical signals;

a driving motor mechanically connected through said shafts to said tires;

a steering unit mechanically connected to at least one of said shafts mechanically connected to said tires; and a control unit electrically connected to both said driving motor and said steering control unit for receiving said electrical signals and subsequent controlling of said driving motor and further controlling of said steering unit.

8. The toy vehicle as claimed in claim 7, wherein a motion of said pushing up member is placed under a radio control carried out according to said radio wave signals from said transmitter.

9. The toy vehicle as claimed in claim 1, wherein a motion of said pushing up member is placed under a hand control carried out by switching a hand switch.

10. A radio controlled toy traveling vehicle comprising:

a body;

a chassis at least having an upper surface; and means provided on said upper surface of said chassis for permitting said body to exhibit a rolling oscillation motion around a horizontal axis, said means comprising:

at least two pairs of tires so mounted on shafts to said chassis as to permit said tires to freely rotate;

at least an antenna for receiving radio wave signals from a transmitter and subsequently converting said radio wave signals into electrical signals;

a driving motor mechanically connected through said shafts to said tires;

a steering unit mechanically connected to at least one of said shafts mechanically connected to said tires;

a control unit electrically connected to both said driving motor and said steering control unit for receiving said electrical signals and subsequently controlling said driving motor and further controlling said steering unit;

a plate mounted on an internal surface of said body;

a plurality of connection rods for mechanically and movable connecting said plate to said upper surface of said chassis; and at least a pushing up member mechanically connected to said chassis and having at least two contacting portions for contacting on a flat bottom surface of said plate at least at two symmetrical positions on opposite sides of a vertical plane containing said horizontal axis so as to permit either of said two contacting portions to push up said bottom surface of said plate wherein said two contacting portions alternatively and continuously push up said bottom surface of said movable plate to permit both said movable plate and said body to show a rolling oscillation motion around said horizontal axis.

11. The toy vehicle as claimed in claim 10, wherein said pushing up member comprises a V-shaped lever including a base portion pivotally connected to said chassis and two top pushing up portions spaced from each other on opposite sides of said plane.

12. The toy vehicle as claimed in claim 11, wherein said V-shaped lever is mechanically connected through a shaft to a rotator which is controllable to exhibit a rotational oscillation motion in a range of a rotational angle at a time period.

13. The toy vehicle as claimed in claim 12, wherein said V-shaped lever is further mechanically connected through a shaft to a rotational angle detector electrically connected to a controller electrically connected to a rotator so as to permit said rotational angle detector to detect a rotational angle of said V-shaped lever so that when a rotational angle detected by said detector reaches a predetermined critical angle, said detector outputs a critical angle signal to be transmitted to said controller and subsequently said controller supplies an inversion signal to said rotator whereby the direction of the rotation of said rotator is reversed.

14. The toy vehicle as claimed in claim 13, wherein said rotator comprises a servomotor.

15. The toy vehicle as claimed in claim 10, wherein said connection rods comprise:

a first connection rod having one end pivotally connected with said upper surface of said chassis at its first side and the opposite end pivotally connected with said bottom surface of said movable plate at its second side and said first connection rod extending across said longitudinal axis of said vehicle;

a second connection rod having one end pivotally connected with said upper surface of said chassis at its second side and the opposite end pivotally connected with said bottom surface of said movable plate at its first side, said second connection rod extending across said longitudinal axis of said vehicle and said second connection rod also being parallel to and adjacent to said first connection rod;

a third connection rod having one end pivotally connected with said upper surface of said chassis at its first side and the opposite end pivotally connected with said bottom surface of said movable plate at its second side, said third connection rod extending across said longitudinal axis of said vehicle and said third connection rod being spaced from said first and second connection rods along said longitudinal axis; and a fourth connection rod having one end pivotally connected with said upper surface of said chassis at its second side and the opposite end pivotally connected with said bottom surface of said movable plate at its first side, said fourth connection rod extending across said longitudinal axis of said vehicle and said fourth connection rod also being parallel to and adjacent to said third connection rod.

16. The toy vehicle as claimed in claim 15, wherein each of said first to fourth connection rods is provided at its opposite ends with brackets fixed to said upper surface of said chassis or said bottom surface of said movable plate.

17. The toy vehicle as claimed in claim 10, wherein a motion of said pushing up member is placed under a radio control carried out according to said radio wave signals from said transmitter.

18. The toy vehicle as claimed in claim 10, wherein a motion of said pushing up member is placed under a hand control carried out by switching a hand switch.

* * * * *